United States Patent [19]

Russo et al.

[11] 4,422,195

[45] Dec. 27, 1983

[54] FITTED BED SHEET AND METHOD OF MANUFACTURE

[75] Inventors: Joseph L. Russo; Richard Sonder, both of New York, N.Y.

[73] Assignee: Simmons Universal Corporation, New York, N.Y.

[21] Appl. No.: 310,454

[22] Filed: Oct. 13, 1981

[51] Int. Cl.[3] ..... A47G 9/02

[52] U.S. Cl. ..... 5/497; 5/495

[58] Field of Search ..... 5/495–499, 5/482, 485, 502, 448

[56] References Cited

U.S. PATENT DOCUMENTS

| | | | |
|---|---|---|---|
| D. 159,688 | 8/1950 | Socol | D6/79 |
| D. 236,776 | 9/1975 | Phillips et al. | D6/79 |
| 1,190,266 | 7/1916 | Crooker . | |
| 1,327,824 | 1/1920 | Holland . | |
| 1,856,799 | 5/1932 | Waters . | |
| 2,162,755 | 6/1939 | Shauer . | |
| 2,454,463 | 11/1948 | Kromer et al. . | |
| 2,598,141 | 5/1953 | Simpson . | |
| 2,637,049 | 5/1953 | Kromer et al. . | |
| 2,662,234 | 12/1953 | Citron . | |
| 2,994,094 | 8/1961 | Hester . | |
| 3,156,280 | 11/1964 | Affholter . | |
| 3,208,419 | 9/1965 | Frydryk . | |
| 3,638,252 | 2/1972 | Palenske et al. | 5/497 |
| 3,681,795 | 8/1972 | Palenske et al. | 5/497 |
| 3,694,832 | 10/1972 | Jamison | 5/497 |

*Primary Examiner*—Alexander Grosz

*Attorney, Agent, or Firm*—Bell, Seltzer, Park & Gibson

[57] ABSTRACT

A fitted bed sheet is adapted for use with a relatively thin mattress having cutaway corners. The fitted sheet is formed from a blank of sheet material to have corner pockets that easily fit over the mattress corners. In particular embodiments the sheet is formed from the blank by a series of folding operations and is then stitched at the corner pockets to complete the sheet. The resulting fitted sheet may be ironed in conventional flat-ironing machines and may be folded into a compact form by an automatic folding machine.

13 Claims, 13 Drawing Figures

FITTED BED SHEET AND METHOD OF MANUFACTURE

BACKGROUND OF THE INVENTION

1. Field of the Invention

The invention relates to fitted bed sheets and methods of forming such sheets.

2. Description of the Prior Art

Conventional fitted sheets or "contour" sheets having elastic or shirring at the corners have been in widespread use for years to serve as the bottom sheet overlying standard mattresses. Because of the well-known problem of flat sheets loosening when used as the bottom sheet on hospital beds, particularly when the bed is articulated, conventional three-dimensional type fitted sheets have been used to some extent in hospitals. However, for a number of reasons such conventional fitted sheets are unsuitable for hospital and other institutional uses. Among these reasons is the high cost of such fitted sheets. Further, the elastic at the corners tends to break down in the laundering and ironing process. These conventional sheets are also difficult to handle in typical flat-ironer machines. To eliminate ironing, the fitted sheets have been manufactured with blends of natural and synthetic fibers so that they may be conditioned and dried in tumblers or they may be air-dried. However, this requires the use of particular types of fibers and increases the expense.

Furthermore, conventional fitted sheets cannot be handled by automatic folding machines. Because of the sheets' three-dimensional (or "developed") shape, any folding process (hand or automatic) results in an uneven, space-consuming volume that does not lend itself to neat stacking. Yet another disadvantage of conventional fitted sheets is that the bed making operation requires considerable physical effort because a relatively heavy and inflexible mattress must be fitted at the corners or ends to get the sheet in place.

Therefore, there is an acute need for a fitted sheet that will overcome these disadvantages, especially for hospital and other institutional uses.

SUMMARY OF THE INVENTION

In accordance with the present invention a fitted sheet is provided that overcomes the disadvantages of the prior art practices, particularly when the sheet is designed for use in association with a relatively thin mattress having cutaway or chamfered corners. The sheet of the invention is made without elastic or shirring at the corners, thereby reducing cost and rendering the sheet suitable for ironing on flat ironing machines and folding by automatic folding machines. Further, the sheets of the invention may greatly reduce labor costs associated with bed making and mattress handling.

In accordance with one aspect of the invention, there is provided a fitted bed sheet for use in association with a particular type of octagonal mattress for use on hospital type beds. The fitted sheet comprises an octagonal panel whose perimeter defines a pair of opposed sides, a pair of opposed ends and four corners, with each corner joining a side to an adjacent end. The sides of the sheet are approximately three times the length of the ends and approximately five times the length of the corners. The fitted sheet further includes a continuous panel joined to the octagonal panel along a juncture running the entire perimeter of the octagonal panel. The continuous panel overlies a continuous perimetric portion of the octagonal panel and has a width throughout its course of approximately one-fourth of the distance that separates the sides.

The fitted sheet may be formed by folding a blank of sheet material in which case the juncture may comprise fold lines.

In a particular embodiment each corner on the perimeter of the octagonal panel has a substantially equal length, C, and forms angles on the order of 135° with the adjacent sides and ends. In this embodiment, the fitted sheet may be conveniently formed so that the width of the portions of the continuous panel that run along the sides and ends is on the order of $C/\sqrt{2}$.

In accordance with another aspect of the invention, there is provided a fitted bed sheet for use in covering a mattress that is rectangular except for cutaway or chamfered corners thereof. The cutaway corners of opposite ends of the mattress provide what may be termed a male "lead in chamfer" at each end. The fitted sheet comprises a substantially rectangular central panel having a main portion approximating the size and shape of a mattress to be covered and corner portions which approximate in size and shape the corners which have been cut away from the mattress to be covered. The cutaway corners of the sheet correspond with the cutaway corners of the mattress and provide what may be termed a female "lead in chamfer." The boundary between the main portion and each corner portion of the central panel defines a corner fold line. The fitted sheet further includes opposing side and end panels formed integrally with the central panel to define side and end fold lines. The side and end panels are inwardly folded along the side and end fold lines to overlie a marginal perimetric portion of the central panel and the central panel corner portions are inwardly folded along the corner fold lines to overlie portions of the adjacent inwardly folded side and end panels and are secured thereto to form corner pockets for receiving corners of a mattress to be covered.

For use in covering mattresses having corners which are angled at 135° to the adjacent mattress side and end edges, the fitted sheet of the invention may be formed with side and end panels that are substantially the same width and with corner pockets that are angled at 135° to the adjacent side and end fold lines.

The central panel corner portions and adjacent side and end panels may be secured together by stitching, preferably stitching which comprises a triangular pattern along the outside edges of the corner portions. The male lead in chamfer on the ends of the mattress and the female lead in chamfer on the ends of the sheet easily mate with each other so that the sheet may be easily placed in position on the mattress to cover the top, sides, and bottom perimeter portions thereof.

In accordance with yet another aspect of the invention, there is provided a method of forming a fitted bed sheet from a blank having the described rectangular central panel, opposed side panels and opposed end panels. The method includes the steps of folding the side and end panels inwardly along their respective fold lines and onto the central panel, folding each central panel corner portion inwardly along its respective corner fold line to overlie portions of the adjacent inwardly folded side and end panels, and securing each central panel corner portion to the adjacent inwardly folded side and end panels.

BRIEF DESCRIPTION OF THE DRAWINGS

The invention will be more fully understood from the following detailed description thereof taken in connection with the accompanying drawings, which forms a part of this application and in which dashed lines denote the "fold lines" and dotted lines denote stitching.

DETAILED DESCRIPTION OF THE INVENTION

Figures 1, 2, 3, 4, 5, 6, 7, 8:
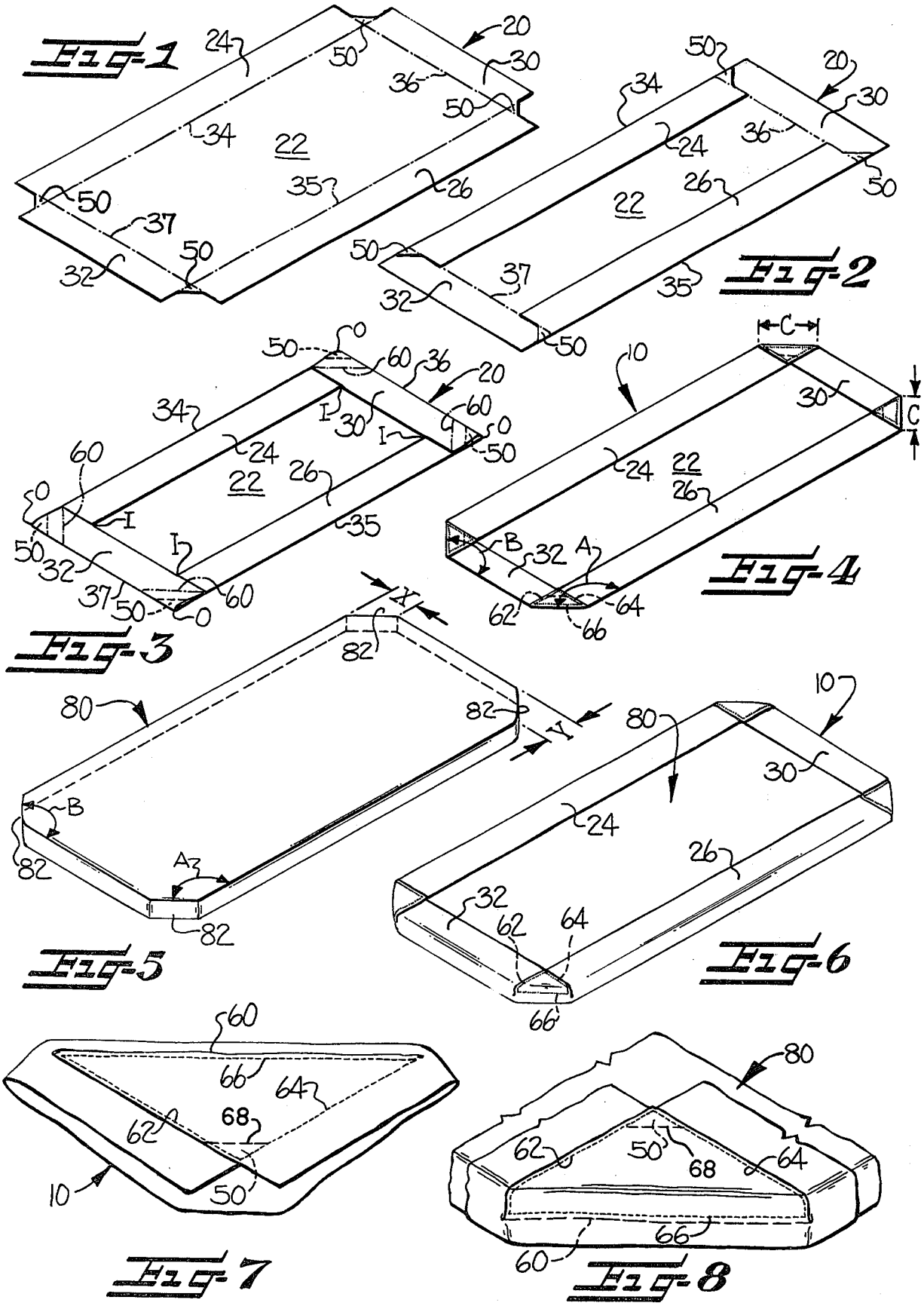
FIG. 1 is an isometric view of a blank of sheet material prior to being folded and stitched to form a fitted bed sheet of the invention.
FIG. 2 is a view similar to FIG. 1 showing the blank after the side panels have been inwardly folded along their respective fold lines.
FIG. 3 is a view similar to FIG. 2 showing the blank after the end panels have been inwardly folded along their respective fold lines.
FIG. 4 is a view similar to FIGS. 2 and 3 showing the complete fitted sheet.
FIG. 5 is an isometric view of a mattress of a type suited for being used in association with the fitted sheet of the invention.
FIG. 6 is a bottom view of the mattress of FIG. 5 after having been covered by the fitted sheet of the invention.
FIG. 7 is an enlarged, fragmentary view of a corner of the complete sheet after having been turned insideout to better illustrate the stitching pattern.
FIG. 8 is an enlarged, fragmentary view of one corner of the sheet in place over a mattress.
Figure 9:
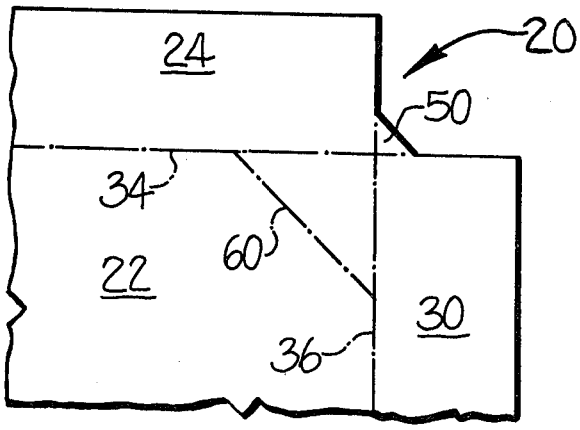
FIG. 9 is an enlarged view of one corner of the blank of sheet material shown in FIG. 1.

While the present invention will be described hereinafter with particular reference to the accompanying drawings, it is to be understood at the outset of the description which follows that it is contemplated that the present invention may be varied in specific detail while still achieving the desirable characteristics and features of the present invention. Accordingly, the description is to be understood as a broad enabling teaching directed to persons skilled in the applicable arts, and is not to be understood as restrictive.

Referring to the drawings, and particularly to FIGS. 1–4, there is shown in sequence the stages of forming a particular embodiment of the fitted bed sheet 10 of the invention from a blank 20 of sheet material. Sheet 10 is preferably formed from textile material of a type suitable for use in bed sheets, but may be formed from other suitable material, such as disposable non-woven material. While not shown in the drawings, the ends of the blank may be hemmed by straight stitching to avoid unraveling and the side edges may be formed selvages, or hemmed.

The illustrated sheet is adapted for use in covering a mattress such as mattress 80 of FIG. 5. Mattress 80 is substantially rectangular except for the "cutaway" or "chamfered" corners 82, which actually give the mattress an octagonal shape. The advantages of this mattress configuration and the manner in which it cooperates with the fitted sheets of the invention will be discussed in detail below.

Blank 20 includes a rectangular central panel 22, a pair of opposed side panels 24, 26 and a pair of opposed end panels 30, 32. The side and end panels are formed integrally with the central panel 22 to define side fold lines 34, 35 and end fold lines 36, 37.

The rectangular central panel 22 has a main portion approximating the size and shape of a mattress to be covered (e.g., mattress 80) and four corner portions which approximate in size and shape of the corners which have been "cut away" from the mattress to be covered. Thus, in the illustrated embodiment the main portion is octagonal and the corner portions are triangular. The boundary between the main portion and each corner portion defines a corner fold line 60.

The first stage of forming the fitted bed sheet 10 is illustrated in FIG. 2 wherein side panels 24, 26 have been inwardly folded along their respective fold lines 34, 35 to overlie marginal perimetric portions of the central panel 22. Next, end panels 30, 32 are inwardly folded along their respective fold line 36, 37 to form the intermediate stage of manufacture shown in FIG. 3.

In the next stage of manufacture, the central panel corner portions are inwardly folded along their respective corner fold lines 60 to overlie portions of the adjacent inwardly folded side end panels. As shown in FIG. 3, the central panel corner portion is preferably folded such that the outer point "O" overlies the inner point "I." The completed sheet 10 is formed by securing the central panel corner portions to the underlying side and end panels.

Referring to FIGS. 7 and 8, there is shown the preferred manner of securing the corner portions. A triangular pattern of straight stitches 62, 64, 66 secure the material at the edges of the triangle that is formed when the corner portions are folded over. In addition, a stitch 68 secures the triangular gusset 50 (discussed below) that is sandwiched in the layers of material. The stitching pattern lends itself to rapid, automatic sewing.

It will be appreciated that the complete fitted sheet 10 has corners that are angled at angles A and B (FIG. 4) of 135° to the adjacent side and end fold lines. The sheet is, therefore, adapted to fit over a mattress having similar cutaway corners. The 135° angles are best achieved by providing side and end panels of equal width. By varying the widths of the side and end panels and/or varying the positioning of the fold lines, the fitted sheet of the invention may be provided with angles other than 135° to both the side and end. For example, the corner may form an angle A of 130° with the side fold line and an angle B of 140° with the end fold line to accommodate a mattress with corners so cut away.

Referring back to FIG. 4, it can be seen that the complete fitted bed sheet product of the invention may be defined as follows. The fitted sheet comprises an octagonal panel whose perimeter defines a pair of opposed sides, a pair of opposed ends and four corners, with each corner joining a side to an adjacent end. In actual practice of the invention, the sides should be approximately three times the length of the ends and approximately five times the length of the corners. The complete fitted sheet product further includes a continuous panel joined to the octagonal panel along a juncture running the entire perimeter of the octagonal panel. The continuous panel overlies a continuous perimetric portion of the octagonal panel and should have a width throughout its course of approximately one-fourth of the distance separating the opposed sides.

In the particular embodiment illustrated in FIG. 4, each corner on the perimeter of the octagonal panel has a substantially equal length C, and forms angles on the order of 135° with the adjacent sides and ends. Further, it can be seen that the width of the portions of the continuous panel that run along the sides and ends is equal to $C/\sqrt{2}$. This relationship exists because the corners form the hypotenuse of right, equilateral triangles, the sides of which are equal in length to the width of the mentioned panel portions.

As stated above, fitted sheet 10 is particularly well adapted for use with a mattress such as mattress 80 illustrated in FIGS. 5 and 6. Preferably, mattress 80 is a relatively thin mattress on the order of 3½ inches in thickness and, because of its ability to easily articulate and other characteristics, is well suited for use in a hospital environment. Mattress 80 may take the form of the "top pad" of the mattress assembly described in copending application Ser. No. 129,620, filed Mar. 12, 1980, now U.S. Pat. No. 4,316,298, issued Feb. 23, 1982, except that the corners of mattress 80 are preferably cut away as at 82. The teachings of said copending Ser. No. 129,620 now U.S. Pat. No. 4,316,298 are incorporated herein by reference.

Because mattress 80 is relatively thin, as opposed to usual mattresses having a thickness on the order of 5 to 6 inches, the "undeveloped" two-dimensional configuration of the corner pockets of sheet 10 is well adapted to conform to the mattress corners. With the mattress corners cutaway as shown at 82, the undeveloped corners of sheet 10 slip easily over the mattress corners. Since portions of the side panels 24, 26 and portions of the end panels 30, 32 underlie a peripheral portion of the mattress 80 (FIG. 6), it is virtually impossible to dislodge the sheet from the mattress, even when the mattress is used on a hospital bed and articulated in one or more locations, so that the sheet stays neatly and securely in place on the mattress.

As shown in FIG. 8, the stitch 66 at each corner pocket of sheet 10 is adapted to reside along the cutaway corner of the mattress. While stitch 66 may reside along the upper edge of the mattress corner, in practice it best resides along the corner approximately halfway between the top and bottom surfaces of the mattress. This positioning of the corner pockets of sheet 10 provides an excellent, tight fit that cannot be achieved on a thin mattress with a conventional fitted sheet.

The particular blank 20 used to form the illustrated fitted sheet 10 is shown in FIG. 1, with an enlarged view of one corner thereof being shown in FIGS. 7 and 8. Material has been removed from the outwardly lying portion of each blank corner area (as defined by extensions of the side and end fold lines and extensions of the outside edges of the side and end panels) leaving a gusset 50 as the only material in the blank corner area. The use of this particular blank configuration serves to provide the desired strength and integrity at the corner pockets of the fitted sheets without the unnecessary bulk that results from the use of a full rectangular blank. Gusset 50 may be easily stitched in place and serves to reinforce the corner pocket where it is subject to wear.

OTHER BLANK CONFIGURATIONS

Figure 10:
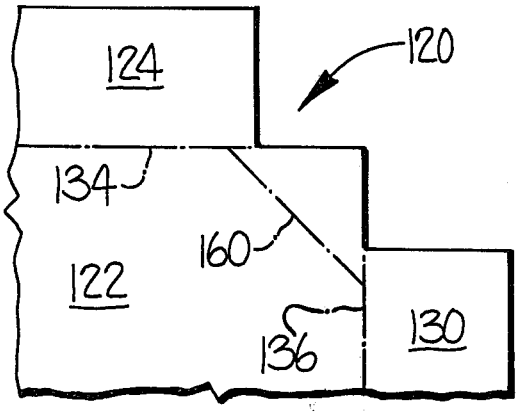
FIGS. 10 and 11 are enlarged views of corners of two other blanks from which fitted sheets within the scope of the invention may be made.
Figure 11:
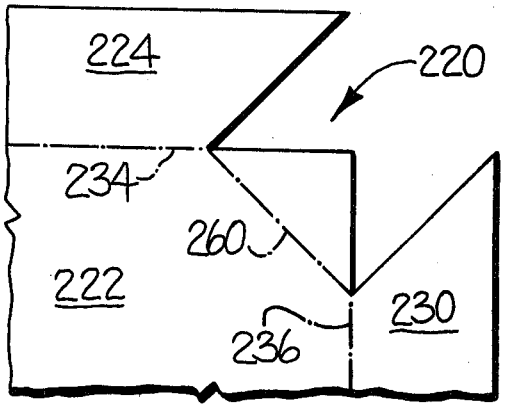

As noted above, a blank 20 as shown in FIG. 1, or a full rectangular blank, may be utilized to form fitted sheets in accordance with the invention. What is desirable is that when the central panel corner portions are inwardly folded, the corner portions should overlie some part of the adjacent side and end panels so that the corner portions may be secured thereto to form a corner pocket of the fitted sheet. This desirable result may be achieved with various blank configurations. Two such configurations are illustrated in FIGS. 10 and 11 which show the corners of blanks 120 and 220, with the reference numerals, as increased by 100 and 200, respectively, referring to corresponding elements of blank 20.

EXAMPLE

A sheet was formed for use with a mattress as shown in FIG. 5 wherein the mattress length was 78 inches, the mattress width was 35 inches, the mattress thickness was 3½ inches, and the corners were cut away to form angles A and B of 135° with the adjacent sides and ends of the mattress. The dimensions X and Y (FIG. 5), corresponding to the amount by which the ends and sides of the mattress were shortened by the cutaway mattress corners, were both 8½ inches.

The fitted sheet designed to accommodate this mattress was formed from a blank having the configuration shown in FIG. 1. The overall dimensions of the blank were 95 inches by 52 inches. The side and end panels were both 8½ inches wide. The gussets 50 were right, equilateral triangles having equilateral sides measuring approximately 1½ inches.

The fitted sheet was formed by folding and then stitching in the triangular pattern discussed above. The fitted sheet had an octagonal panel with the distance between the opposed ends being 78 inches and the distance between the opposed sides being 35 inches. The width of the portions of the continuous overlying panel that run along the sides and ends was on the order of 8½ inches (the width of the side and end panels). The corners of the octagonal panels were substantially equal in length and formed angles of 135° with the adjacent sides and ends. Thus, the length C, of the corners was on the order of $8\frac{1}{2}$ inches $\times\sqrt{2}=12.02$ inches.

OTHER FEATURES AND ADVANTAGES

The initial cost of sheets manufactured in accordance with the invention can be competitive because the amount of material used is approximately 68% of that used for a standard flat sheet. (A standard sheet is 66"×104" or 6,864 square inches, whereas the blank sheet 10 of the above example is 4,676 square inches.) Cutting is simple, and sewing is straightforward and easily automated. The sheets of the invention do not have (not do they require) elastic or shirring. Since they can be made of the same fabric as flat sheets, they will withstand processing as well as flat sheets and do not require air drying.

Figure 12:
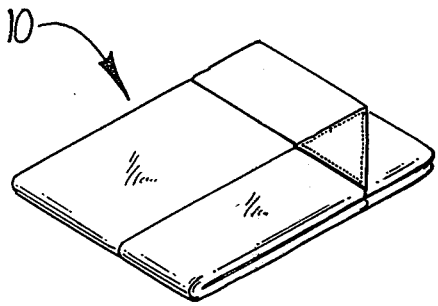
FIG. 12 is a pictorial view of a fitted sheet of the invention in the folded state.
Figure 13:
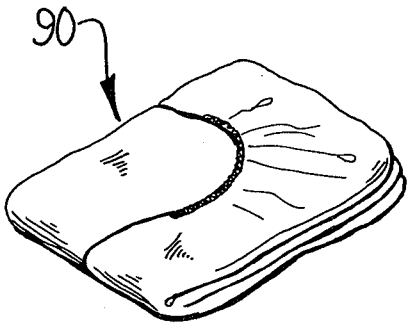
FIG. 13 is a pictorial view of a conventional contour sheet having elastic and shirring, in the folded state.

The two dimensional sheets of the invention can be processed through typical flat-ironing machines at rates the same or better than standard flat sheets. Since the overall area to be ironed is approximately 40% of a regular flat sheet, the production rate can be considerably higher. Furthermore, the sheets may be readily handled by an automatic folding machine. The sheets fold neatly and stack compactly as shown by the comparison of a folded sheet 10 of the invention (FIG. 11) and a folded conventional fitted sheet 90 with elastic (FIG. 12).

The sheets of the invention are extraordinarily easy to put on and take off mattresses, especially thin mattresses formed with cutaway corners. Because the thin mattress is light and extremely flexible, it is not necessary to expend great physical effort to make the bed, nor does the attendant have to get to the head of the bed to get a neat fit; the bed can be made from the sides.

The sheets can find excellent application whereever thin mattresses of the type described in copending application Ser. No. 129,620 now U.S. Pat. No. 4,316,298 can be utilized, for example, in hospitals, domestic application, hotels, dormitories and other institutions. A particular application of the sheets is for use in the sofa bed market, which is constrained to the use of thin mattresses because of the extreme articulation of the mattress support mechanism. The two dimensional sheets of the invention will stay in place even during the bending and unbending modes of the mattress in this type of application. Use of standard contour sheets on these thin mattresses is very unsatisfactory.

Another significant application for the sheets is in the increasing market for electric beds for domestic use (reading, television, etc.). All of the problems associated with articulating hospital beds and sofa beds apply to such beds.

Hospitals and other institutions may realize significant advantages in using the more manageable sheet 10 of the invention to gain user comfort without sacrificing economy, particularly when used in association with thin mattresses having a thickness on the order of $3\frac{1}{2}$ inches or less. The engagement of the two dimensional sheet with the top, sides and bottom perimeter portions of the thin mattress provides full stability of the sheet on the mattress at all times, even when the mattress is articulated. The ease of mattress handling and bed making represents an identifiable reduction in labor costs.

The sheets of the invention may also facilitate the introduction of disposable non-woven fiber bed sheets to the institutional market. Such attempts have met with very limited success, largely due to the noncompetitive cost per unit. However, it is significant to note that sheet 10 uses only 68% of the material required for a standard non-fitted sheet and it can be manufactured simply and can be folded and packaged compactly. The smaller area and lower weight of sheet 10 obviates some of the disadvantages associated with the bulk of ultimate waste disposal and results in the use of less storage space in the central warehouse and on the linen cart.

While the invention has been described in connection with a preferred embodiment, it will be appreciated that modifications may be made without departing from the true spirit and scope of the invention.

What is claimed is:

1. A fitted bed sheet for use in association with an octagonal mattress, said fitted sheet comprising an octagonal panel whose perimeter defines a pair of opposed sides, a pair of opposed ends and four corners each corner joining a side to an adjacent end each of said opposed sides being at least twice as long as each of said opposed ends, and a continuous panel integrally joined to said octagonal panel along a juncture comprised of fold lines running the entire perimeter of said octagonal panel.

2. A fitted bed sheet as claimed in claim 1 wherein each corner on the perimeter of the octagonal panel has a substantially equal length C, and forms angles on the order of 135° with the adjacent sides and ends.

3. A fitted bed sheet as claimed in claim 2 wherein the width of the portions of the continuous panel that run along the sides and ends is on the order of $C/\sqrt{2}$.

4. A fitted bed sheet formed from sheet material and adapted for use in covering a mattress that is substantially rectangular except for cutaway corners thereof, said fitted sheet comprising a rectangular central panel having a main portion approximating the size and shape of a mattress to be covered and corner portions which approximate in size and shape the corners which have been cut away from the mattress to be covered, the boundary between the main portion and each corner portion defining a corner fold line, opposing side and end panels formed integrally with said central panel to define side and end fold lines with said central panel, said side and end panels being inwardly folded along said side and end fold lines to overlie a marginal perimetric portion of the central panel, and said central panel corner portions being inwardly folded along said corner fold lines to overlie portions of the adjacent inwardly folded side and end panels and being secured thereto to form corner pockets for receiving the cutaway corners of a mattress to be covered.

5. A fitted sheet as claimed in claim 4 wherein said central panel corner portions are triangular and said corner fold lines are at 135° angles to the adjacent side and end fold lines.

6. A fitted sheet as claimed in claim 4 or 5 wherein the widths of said side and end panels are substantially the same and are on the order of $8\frac{1}{2}$ inches.

7. A fitted sheet as claimed in claim 4 wherein the central panel corner portions and adjacent side and end panels are secured together by stitching.

8. A fitted sheet as claimed in claim 7 wherein the stitching comprises a triangular pattern along the outside edges of said corner portions.

9. A fitted sheet as claimed in claim 4 wherein the sheet material from which said fitted sheet is formed is a blank that is rectangular except that in the blank corner areas, as defined by extensions of said side and end fold lines and extensions of the outside edges of the side and end panels, an outwardly lying portion of each such blank corner area is devoid of material.

10. A fitted sheet as claimed in claim 9 wherein each blank corner area includes a gusset at the intersection of the respective side and end fold lines, with the remaining area of each blank corner area being devoid of material.

11. A fitted sheet as claimed in claim 10 wherein the central panel corner portions and adjacent side and end panels are secured together by stitching in a triangular pattern along the outside edges of said corner portions and said gusset is secured therebetween by stitching.

12. A method of forming a fitted bed sheet comprising the steps of:

forming a blank including (i) a substantially rectangular central panel having a main portion approximating the size and shape of a mattress to be covered and corner portions that approximate in size and shape the corners which have been cut away from the mattress, the boundary between the central panel main portion and each corner portion defining a corner fold line;

(ii) a pair of opposed side panels, each side panel being formed integrally with said central panel to define a side fold line with said central panel;

(iii) a pair of opposed end panels, each end panel being formed integrally with said central panel to define an end fold line with said central panel;

folding the side panels inwardly along the respective side fold lines and onto the central panel;

folding the end panels inwardly along the respective end fold lines and onto the central panel;

folding each central panel corner portion inwardly along its respective corner fold line to overlie portions of the adjacent inwardly folded side and end panels; and securing each central panel corner portion to the adjacent inwardly folded side and end panels.

13. A method as claimed in claim 12 including the step of forming the blank with gussets at the intersections of the side and end fold lines.

* * * * *